US011215187B2

(12) United States Patent
Saegusa et al.

(10) Patent No.: US 11,215,187 B2
(45) Date of Patent: Jan. 4, 2022

(54) VACUUM PUMP, AND WATERPROOF STRUCTURE AND CONTROL APPARATUS APPLIED TO VACUUM PUMP

(71) Applicant: Edwards Japan Limited, Yachiyo (JP)

(72) Inventors: Kengo Saegusa, Yachiyo (JP); Yanbin Sun, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 137 days.

(21) Appl. No.: 16/341,495

(22) PCT Filed: Sep. 29, 2017

(86) PCT No.: PCT/JP2017/035473

§ 371 (c)(1),
(2) Date: Apr. 12, 2019

(87) PCT Pub. No.: WO2018/074191

PCT Pub. Date: Apr. 26, 2018

(65) Prior Publication Data

US 2019/0242387 A1 Aug. 8, 2019

(30) Foreign Application Priority Data

Oct. 21, 2016 (JP) ..... JP2016-207396

(51) Int. Cl.
*F04D 19/04* (2006.01)
*F04B 37/14* (2006.01)
(Continued)

(52) U.S. Cl.
CPC ..... *F04D 19/042* (2013.01); *F04B 37/14* (2013.01); *F04B 37/16* (2013.01); *F04B 39/00* (2013.01);
(Continued)

(58) Field of Classification Search
CPC .... F04D 25/0693; F04D 19/04; F04D 17/168; F04D 29/083; F04D 25/068;
(Continued)

(56) References Cited

U.S. PATENT DOCUMENTS 5,458,496 A 10/1995 Itou et al.
5,971,725 A * 10/1999 de Simon ..... F04D 19/04 417/423.1
(Continued)

FOREIGN PATENT DOCUMENTS

CN 105408634 A 3/2016
EP 1843043 A2 10/2007
(Continued)

OTHER PUBLICATIONS

Translation of International Search Report and original International Search Report and Written Opinion received in counterpart International Application No. PCT/JP2017/035473 dated Dec. 14, 2017, 6 pp.
(Continued)

*Primary Examiner* — Dominick L Plakkoottam
(74) *Attorney, Agent, or Firm* — Shumaker & Sieffert, P.A.

(57) ABSTRACT

A vacuum pump, and a waterproof structure and a control apparatus applied to the vacuum pump which improve efficiency of on-site maintenance work and prevent water from penetrating into a connector connecting portion when a cover is removed during circuit separation or the like. When performing maintenance work, after a chassis of a control apparatus is lowered by around several tens of millimeters, the chassis of the control apparatus is pulled out in a radial direction of a pump. Accordingly, a pump main body and the control apparatus can be readily attached and detached even when sufficient empty space is not available
(Continued)

in an axial direction of the vacuum pump. A wall portion is circumferentially protrusively provided in side portions of the base portion and the control apparatus. Furthermore, a sealing member and a lid are inserted into a gap. Therefore, water droplets cannot easily penetrate into the gap.

13 Claims, 8 Drawing Sheets

(51) Int. Cl.

| | |
|---|---|
| ***H01R 13/52*** | (2006.01) |
| ***F04B 37/16*** | (2006.01) |
| ***F04B 39/00*** | (2006.01) |
| ***F04D 25/06*** | (2006.01) |
| ***F04D 17/16*** | (2006.01) |

(52) U.S. Cl.
CPC ..... *F04D 17/168* (2013.01); *F04D 19/04* (2013.01); *F04D 25/0693* (2013.01); *H01R 13/52* (2013.01)

(58) Field of Classification Search
CPC .... F04D 29/522; F04D 29/584; F04D 29/601; F04D 19/042; F04D 29/5813; F04D 27/00; F04B 37/14; F04B 39/00; H01R 13/52; H01R 13/631; H01R 13/74; Y10S 439/901; H02K 11/33; H02K 2211/03
See application file for complete search history.

(56) References Cited

U.S. PATENT DOCUMENTS

| | | | | |
|---|---|---|---|---|
| 7,393,228 | B2 * | 7/2008 | Kabasawa | H01R 13/631 439/247 |
| 7,713,087 | B2 * | 5/2010 | Kabasawa | F04D 25/0693 439/606 |
| 8,628,309 | B2 * | 1/2014 | Nagano | F04B 35/045 417/423.4 |
| 8,651,838 | B2 * | 2/2014 | Birkenstock | F04D 29/083 417/423.4 |
| 8,961,105 | B2 * | 2/2015 | Kogame | F04D 19/04 415/55.1 |
| 9,267,392 | B2 * | 2/2016 | Schroder | F04D 25/0693 |
| 9,353,755 | B2 * | 5/2016 | Nagano | F04D 29/5813 |
| 2002/0131877 | A1 | 9/2002 | Omori | |
| 2005/0196285 | A1 * | 9/2005 | Jayanth | H02H 7/08 417/44.11 |
| 2009/0108703 | A1 | 4/2009 | Kawasaki et al. | |
| 2010/0047095 | A1 * | 2/2010 | Englaender | F04D 19/04 417/423.4 |
| 2010/0303650 | A1 * | 12/2010 | Englaender | F04D 19/042 417/422 |
| 2013/0209272 | A1 * | 8/2013 | Omori | F04D 29/5813 417/26 |
| 2015/0016958 | A1 * | 1/2015 | Hofmann | F04D 29/056 415/55.5 |
| 2016/0195098 | A1 * | 7/2016 | Omori | H02K 11/33 417/423.7 |
| 2017/0298922 | A1 * | 10/2017 | Omori | F04B 37/14 |

FOREIGN PATENT DOCUMENTS

| | | | |
|---|---|---|---|
| JP | S63-315024 | A | 12/1988 |
| JP | H07-29631 | A | 1/1995 |
| JP | 3138105 | U | 12/2007 |
| JP | 2016-079906 | A | 5/2016 |

OTHER PUBLICATIONS

Extended Search Report from counterpart European Application No. 17861978.9, dated May 7, 2020, 8 pp.

* cited by examiner

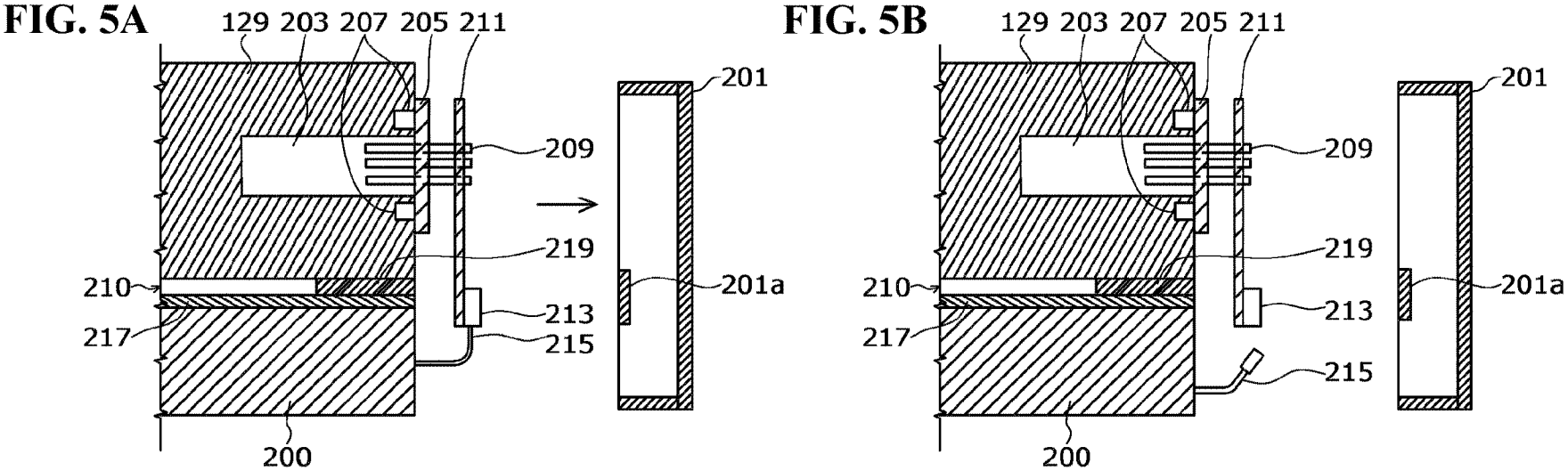
FIG. 5A
FIG. 5B
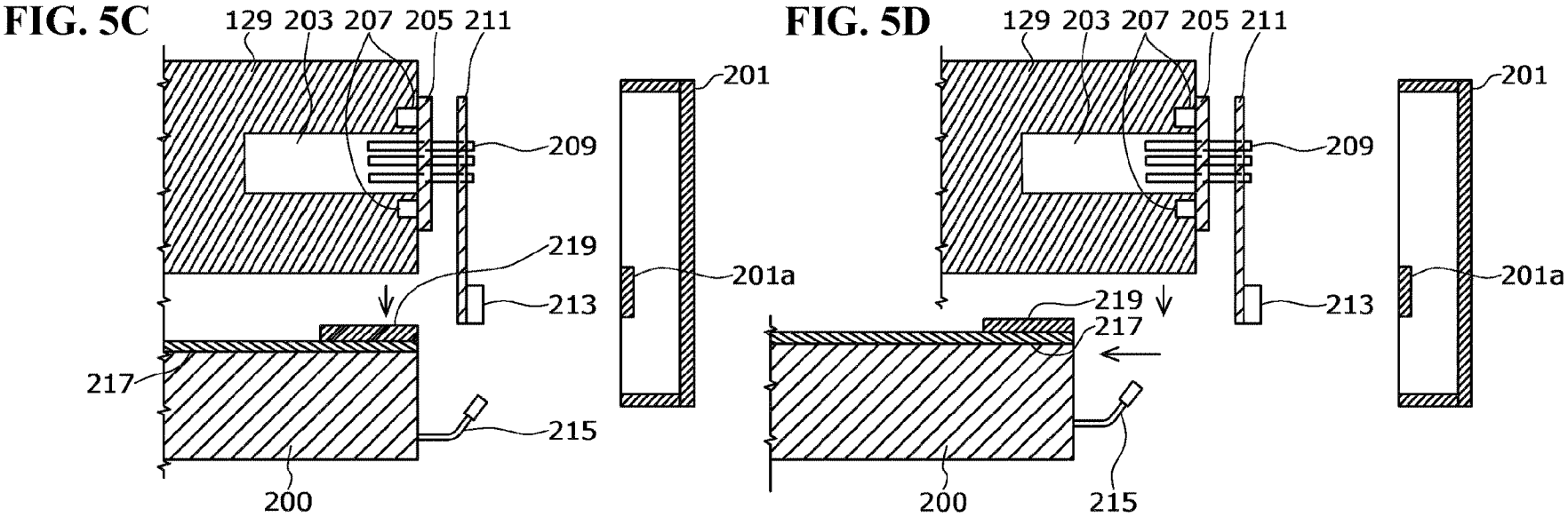
FIG. 5C
FIG. 5D

VACUUM PUMP, AND WATERPROOF STRUCTURE AND CONTROL APPARATUS APPLIED TO VACUUM PUMP

This application is a U.S. national phase application under 37 U.S.C. § 371 of international application number PCT/JP2017/035473 filed on Sep. 29, 2017, which claims the benefit of priority to JP application number 2016-207396 filed Oct. 21, 2016. The entire contents of each of international application number PCT/JP2017/035473 and JP application number 2016-207396 are incorporated herein by reference.

TECHNICAL FIELD

The present disclosure relates to a vacuum pump.

BACKGROUND

With recent developments in electronics, there is a rapidly growing demand for semiconductors such as memories and integrated circuits.

These semiconductors are manufactured by doping an extremely pure semiconductor substrate with an impurity to impart an electric property to the semiconductor substrate, forming a minute circuit on the semiconductor substrate by etching, or the like.

Such operations must be performed inside a chamber in a high-vacuum state in order to circumvent the effect of airborne dust and the like. While vacuum pumps are generally used to exhaust the chamber, in particular, a turbo-molecular pump which is one of such vacuum pumps is frequently used from the perspectives of a small amount of residual gas and easy maintenance.

In addition, a semiconductor manufacturing process includes a large number of steps in which various process gases are caused to act on a substrate of a semiconductor, and a turbo-molecular pump is used not only to vacuumize the inside of a chamber but also to exhaust such process gases from the chamber.

The turbo-molecular pump is constituted by a pump main body and a control apparatus which controls the pump main body.

The pump main body and the control apparatus are usually connected to each other by cables and a connector plug mechanism. In order to avoid hassle due to connection errors and length adjustment of the cables between the pump main body and the control apparatus, structures which make the pump main body and the control apparatus attachable and detachable in an axial direction of a pump are known as disclosed in Japanese Patent Application Laid-open No. H11-173293.

SUMMARY

Generally, empty space around the pump main body and the control apparatus which are integrated as described above is limited. In particular, there is often hardly any available space in the axial direction. Therefore, maintenance must be performed after temporarily detaching the integrated pump main body and the control apparatus from the chamber and moving the still-integrated pump main body and the control apparatus to a location that affords sufficient working space.

In addition, when terminals are arranged in the axial direction in a bottom portion of the pump main body, aligning positions of a terminal on the side of the pump main body and a terminal on the side of the control apparatus requires that a worker check whether the terminals are attached or detached while looking at locations of the terminals through an extremely narrow gap between the pump main body and the control apparatus, thereby making alignment of positions and maintenance work difficult.

Furthermore, a water-cooled tube (to be described later) is arranged in the pump main body. Cooling of the pump main body by the water-cooled tube may cause water droplets such as condensation to form around the pump main body. When separating the pump main body and the control apparatus, there is a risk that the water droplets may penetrate into the connector connecting portion from around the pump main body.

The present disclosure has been developed in consideration of such conventional problems, and an object thereof is to provide a vacuum pump, and a waterproof structure and a control apparatus applied to the vacuum pump which improve efficiency of on-site maintenance work and, at the same time, prevent water from penetrating into a connector connecting portion when a cover is removed during circuit separation or the like.

To this end, the present disclosure (claim 1) provides a vacuum pump in which a control apparatus is detachably arranged with respect to a base portion of a pump main body and which includes a waterproof structure, wherein the waterproof structure includes: a connector portion which is arranged in a side portion of the base portion and which connects the base portion with the control apparatus via an electric cable; a wall portion which is protrusively provided around the connector portion so as to expand from the base portion to the control apparatus; and a wall portion cover which covers the wall portion.

Since the connector is arranged in the side portion of the base portion, the pump main body and the control apparatus can be readily attached and detached even when sufficient empty space is not available in an axial direction of the pump. The wall portion is circumferentially protrusively provided in side portions of the base portion and the control apparatus so as to expand from the base portion to the control apparatus. Therefore, even when a cover is removed during maintenance work, penetration of water droplets can be prevented by the wall portion. Accordingly, safety of circuits during maintenance work can be ensured.

In addition, the present disclosure (claim 2) includes a vacuum pump, the vacuum pump including a gap formed between the base portion and the control apparatus, wherein a gap cover portion which covers an outer periphery of the gap is arranged inside the wall portion cover.

Accordingly, infiltration of water droplets that flow along the gap can be more rigidly prevented. As a result, safety of circuits during maintenance work can be more reliably ensured. The gap cover portion may be integrally configured with respect to the cover or may be configured as a separate body.

Furthermore, the present disclosure (claim 3) includes a vacuum pump, the vacuum pump including a gap formed between the base portion and the control apparatus, wherein an outer periphery of the gap is covered by protrusively providing an outer peripheral surface of the control apparatus on a side of the base portion of the pump main body.

An outer peripheral surface that forms the control apparatus is protrusively provided in the axial direction of the pump. Covering the outer periphery of the gap with the protrusive portion makes it more difficult for water droplets to penetrate into the gap. As a result, safety of circuits during maintenance work can be even more reliably ensured.

In addition, the present disclosure (claim 4) includes a vacuum pump, the vacuum pump including: a gap formed between the base portion and the control apparatus; and a bent part formed by bending an end of an upper surface of the control apparatus toward a side of the base portion of the pump main body, wherein an outer periphery of the gap is covered by the bent part.

A bent part is formed by bending an end of an upper surface of the control apparatus. Covering the outer periphery of the gap with the bent part makes it more difficult for water droplets to penetrate into the gap. As a result, safety of circuits during maintenance work can be even more reliably ensured.

Furthermore, the present disclosure (claim 5) includes a vacuum pump, wherein a sealing member for preventing infiltration of water into the gap is arranged with respect to the gap.

Inserting the sealing member into the gap makes it difficult for water droplets to penetrate into the gap.

In addition, the present disclosure (claim 6) includes a vacuum pump, wherein a groove or a hole for draining water is formed in the wall portion or on the upper surface of the control apparatus.

By forming a groove or a hole through which water droplets pass in the wall portion, since water droplets flow along the groove or the hole even when the cover is removed, water droplets do not penetrate inside. Accordingly, safety of circuits during maintenance work can be ensured.

Furthermore, the present disclosure (claim 7) includes a vacuum pump, wherein the wall portion cover is formed so as to conform to outer shapes of the base portion and the control apparatus.

Accordingly, distracting protrusions around the pump are eliminated to make maintenance work easier and to also improve aesthetics.

In addition, the present disclosure (claim 8) includes a waterproof structure, wherein the waterproof structure is arranged in the vacuum pump according to any one of claims 1 to 7.

Although the vacuum pump includes a large number of cables and tends to be bulky, mounting the waterproof structure enables maintenance work to be easily performed from the side of the pump.

Furthermore, the present disclosure (claim 9) includes a control apparatus, wherein the control apparatus is applied to the vacuum pump according to any one of claims 1 to 7 and is attachable and detachable with respect to the pump main body by moving in a radial direction.

Configuring the control apparatus so as to be movable in the radial direction enables maintenance work to be easily performed even at a location where a sufficient working space cannot be secured in the axial direction of the pump.

As described above, according to the present disclosure (claim 1), since the connector is arranged in the side portion of the base portion and the wall portion is formed around the connector so as to expand from the base portion to the control apparatus, the pump main body and the control apparatus can be readily attached and detached even when sufficient empty space is not available in the axial direction of the pump.

In addition, even when the cover is removed during maintenance work, infiltration of water droplets can be prevented by the wall portion. Accordingly, safety of circuits during maintenance work can be ensured.

BRIEF DESCRIPTION OF THE DRAWINGS

FIGS. 5A to 5D are diagrams showing a procedure when performing maintenance work.

DETAILED DESCRIPTION

Figure 1:
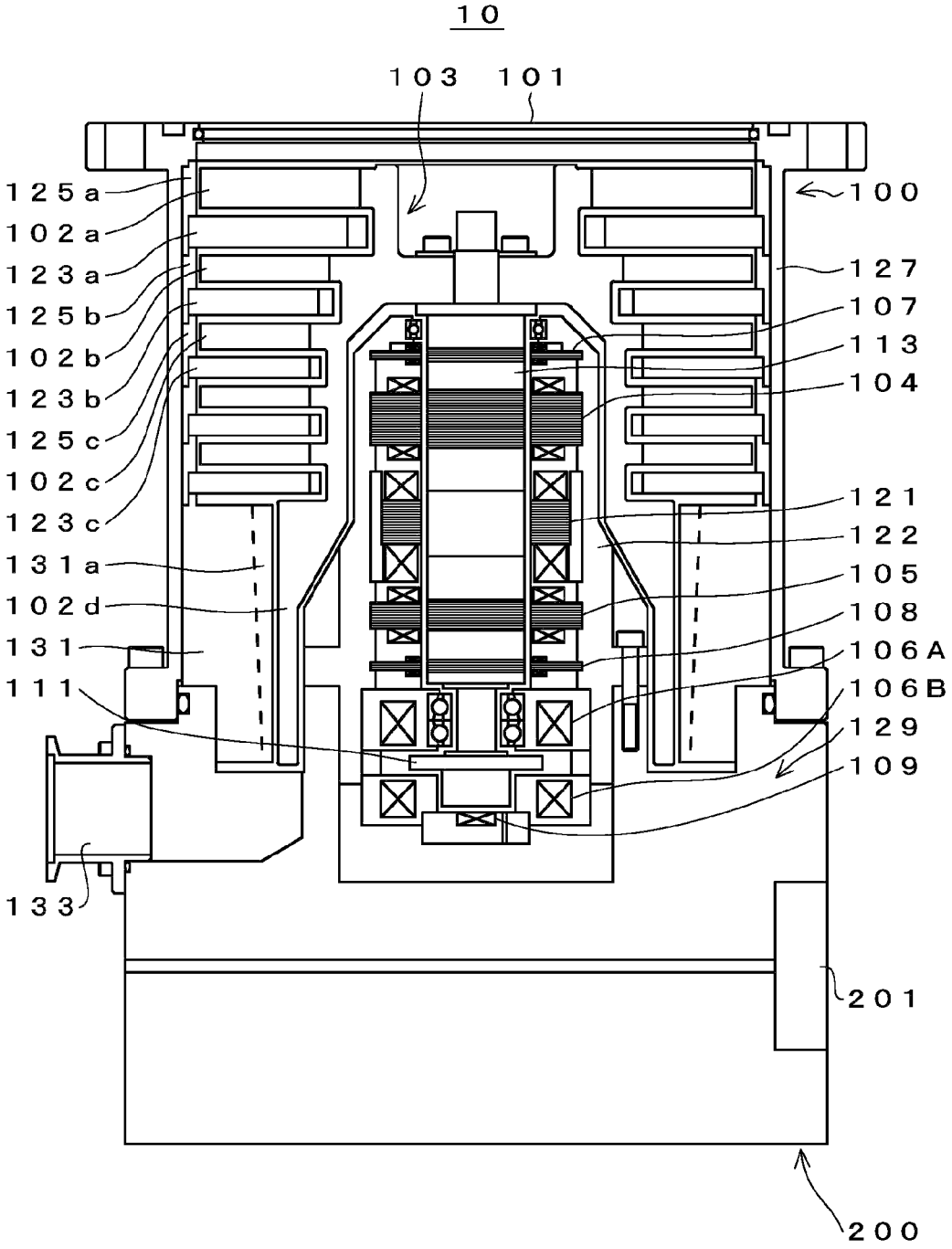
FIG. 1 is a configuration diagram of a first embodiment of the present disclosure.

Hereinafter, a first embodiment of the present disclosure will be described. FIG. 1 shows a configuration diagram of the first embodiment of the present disclosure. In FIG. 1, in a turbo-molecular pump 10, a pump main body 100 and a control apparatus 200 are integrated with each other.

An inlet port 101 is formed at an upper end of a cylindrical outer casing 127 of the pump main body 100. A rotating body 103 in which a plurality of rotor blades 102*a*, 102*b*, 102*c*, . . . constituted by turbine blades for sucking and exhausting gas are radially formed in multiple stages in a peripheral portion inside the outer casing 127.

A rotor shaft 113 is mounted to a center of the rotating body 103 and, for example, a so-called five-axis control magnetic bearing levitates and supports the rotor shaft 113 in midair and controls a position of the rotor shaft 113.

As an upper radial electromagnet 104, four electromagnets are arranged so as to form pairs with respect to mutually orthogonal X and Y axes which are coordinate axes in a radial direction of the rotor shaft 113. An upper radial sensor 107 constituted by four electromagnets is provided in proximity to and in correspondence with the upper radial electromagnet 104. The upper radial sensor 107 is configured so as to detect a radial displacement of the rotating body 103 and to send the detected radial displacement to the control apparatus 200.

In the control apparatus 200, based on a displacement signal detected by the upper radial sensor 107, excitation of the upper radial electromagnet 104 is controlled via a compensation circuit having a PID adjustment function and a position in the radial direction of an upper side of the rotor shaft 113 is adjusted.

The rotor shaft 113 is formed of a high magnetic permeability material (such as iron) or the like and is configured so as to be sucked by a magnetic force of the upper radial electromagnet 104. The adjustment described above is respectively independently performed in an X axis direction and a Y axis direction.

In addition, a lower radial electromagnet 105 and a lower radial sensor 108 are arranged in a similar manner to the upper radial electromagnet 104 and the upper radial sensor 107 and adjust a position in the radial direction of a lower side of the rotor shaft 113 in a similar manner to the position in the radial direction of the upper side.

Furthermore, axial electromagnets 106A and 106B are arranged so as to vertically sandwich a disc-shaped metal disk 111 provided in a lower portion of the rotor shaft 113. The metal disk 111 is constituted by a high magnetic permeability material such as iron. An axial sensor 109 is provided in order to detect an axial displacement of the rotor shaft 113, and the axial sensor 109 is configured so that an axial displacement signal thereof is sent to the control apparatus 200.

In addition, the axial electromagnets 106A and 106B are configured so that excitation thereof is controlled based on the axial displacement signal via the compensation circuit having a PID adjustment function of the control apparatus 200. The axial electromagnet 106A and the axial electromagnet 106B respectively suck the metal disk 111 upward and downward by magnetic force.

As described above, the control apparatus 200 is configured so as to appropriately adjust magnetic forces exerted on the metal disk 111 by the axial electromagnets 106A and 106B in order to magnetically levitate the rotor shaft 113 in the axial direction and hold the rotor shaft 113 in space in a contactless manner.

A motor 121 includes a plurality of magnetic poles circumferentially arranged so as to surround the rotor shaft 113. Each magnetic pole is controlled by the control apparatus 200 so as to rotationally drive the rotor shaft 113 via an electromagnetic force which acts between the magnetic pole and the rotor shaft 113.

A plurality of stator blades 123*a*, 123*b*, 123*c*, . . . are arranged across small gaps from the rotor blades 102*a*, 102*b*, 102*c*, . . . . The rotor blades 102*a*, 102*b*, 102*c*, . . . are formed inclined by a prescribed angle relative to a plane perpendicular to an axial line of the rotor shaft 113 in order to respectively transport a molecule of exhaust gas downward when the exhaust gas collides.

In addition, the stator blade 123 is also formed inclined by a prescribed angle relative to a plane perpendicular to the axial line of the rotor shaft 113 and is arranged so as to alternate with the stages of the rotor blade 102 toward inside of the outer casing 127.

Furthermore, an end of the stator blade 123 is supported in a state of being fitted and inserted between a plurality of stacked stator blade spacers 125*a*, 125*b*, 125*c*, . . . .

The stator blade spacer 125 is a ring-shaped member constituted by, for example, a metal such as aluminum, iron, stainless steel, or copper or a metal such as an alloy containing these metals as components.

The outer casing 127 is fixed across a small gap in an outer periphery of the stator blade spacer 125. A base portion 129 is arranged in a bottom portion of the outer casing 127, and a threaded spacer 131 is arranged between a lower portion of the stator blade spacer 125 and the base portion 129. In addition, an outlet port 133 which communicates with outside is formed in a lower portion of the threaded spacer 131 in the base portion 129.

The threaded spacer 131 is a cylindrical member constituted by a metal such as aluminum, copper, stainless steel, or iron or a metal such as an alloy containing these metals as components, and a spiral thread groove 131*a* is engraved in plurality on an inner circumferential surface of the threaded spacer 131.

A direction of the spirals of the thread grooves 131*a* is a direction in which, when a molecule of exhaust gas moves in a direction of rotation of the rotating body 103, the molecule is transported toward the outlet port 133.

A rotor blade 102*d* is suspended from a lowermost portion which continues from the rotor blades 102*a*, 102*b*, 102*c*, . . . of the rotating body 103. An outer peripheral surface of the rotor blade 102*d* is cylindrical in shape and overhangs toward the inner circumferential surface of the threaded spacer 131, and is in proximity to the inner circumferential surface of the threaded spacer 131 across a prescribed gap.

The base portion 129 is a disc-shaped member constituting a base of the turbo-molecular pump 10 and is generally constituted by a metal such as iron, aluminum, or stainless steel.

Since the base portion 129 physically holds the turbo-molecular pump 10 and also has a function of a heat conductive path, a metal having both rigidity and high thermal conductivity such as iron, aluminum, or copper is desirably used.

In the configuration described above, when the rotor blade 102 is driven by the motor 121 and rotates together with the rotor shaft 113, exhaust gas from the chamber is sucked through the inlet port 101 due to actions of the rotor blade 102 and the stator blade 123.

The exhaust gas sucked from the inlet port 101 passes between the rotor blade 102 and the stator blade 123 and is transported to the base portion 129. At this point, while a temperature of the rotor blade 102 rises due to frictional heat generated when the exhaust gas comes into contact or collides with the rotor blade 102, conduction or radiation of heat generated in the motor 121, or the like, this heat is transferred to the side of the stator blade 123 by radiation, conduction by a gas molecule of the exhaust gas, or the like.

The stator blade spacers 125 are joined to one another in an outer peripheral portion and transfer, to the outer casing 127 and the threaded spacer 131, heat received by the stator blade 123 from the rotor blade 102, frictional heat generated when the exhaust gas comes into contact or collides with the stator blade 123, and the like.

The exhaust gas transported to the threaded spacer 131 is sent to the outlet port 133 while being guided by the thread grooves 131*a*.

In some cases, process gases are introduced in a high-temperature state into a chamber in order to enhance reactivity. In addition, once the process gases are cooled and drop to a certain temperature when exhausted, the process gases may solidify and cause a product to be deposited in an exhaust system.

Furthermore, a process gas of this type may cool and solidify inside the turbo-molecular pump 10 and adhere to and accumulate on the interior of the turbo-molecular pump 10.

When a deposit of a process gas accumulates inside the turbo-molecular pump 10, the deposit may narrow a pump flow path and cause a decline in performance of the turbo-molecular pump 10.

When a temperature near the outlet port is low, the product described above readily solidifies and adheres particularly near the rotor blade 102*d* and the threaded spacer 131. In order to solve this problem, conventionally, a heater or an annular water-cooled tube (not shown) is wound around an outer periphery of the base portion 129 or the like and, for example, a temperature sensor (such as a thermistor) (not shown) is embedded in the base portion 129, whereby heating by the heater or cooling by the water-cooled tube is controlled so as to keep the temperature of the base portion 129 at a constant high temperature (set temperature) based on a signal from the temperature sensor.

Next, a structure around terminals to which a control cable and a power cable are connected between the pump main body 100 and the control apparatus 200 will be described.

Figure 2:
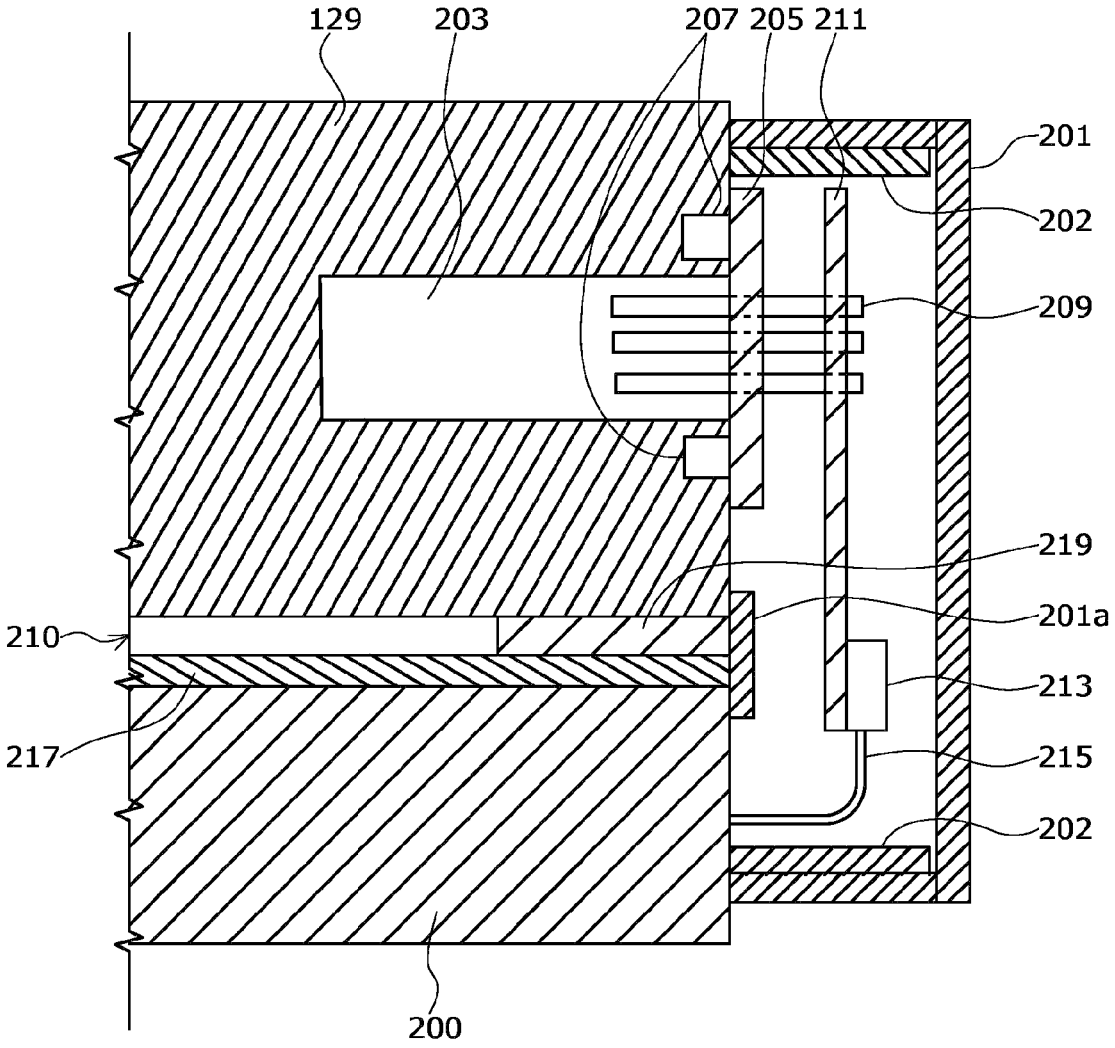
FIG. 2 is a vertical sectional view around a base portion and a control apparatus.
Figure 3:
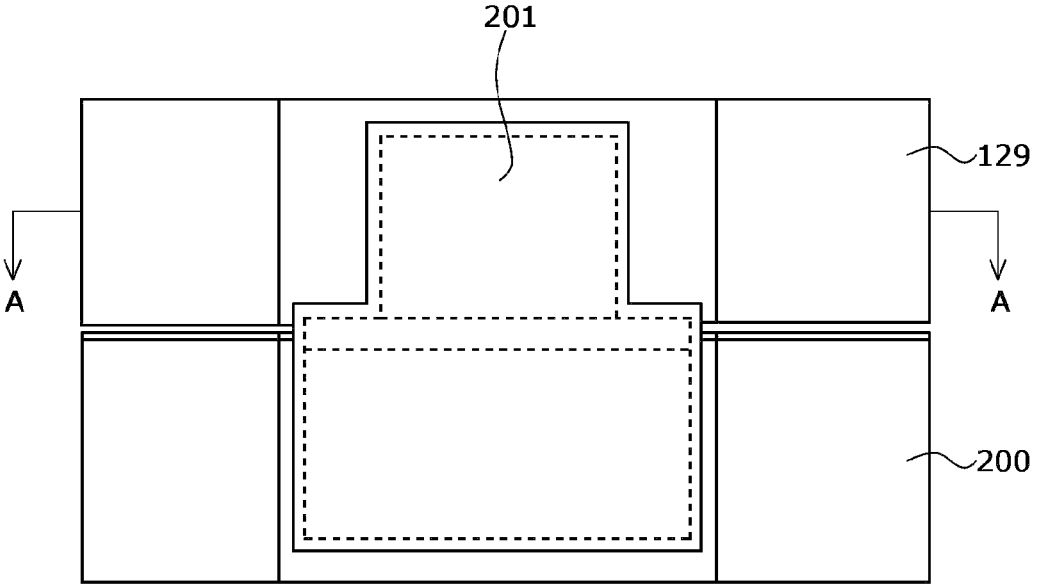
FIG. 3 is a front view of a base portion and a control apparatus including a cover.
Figure 4:
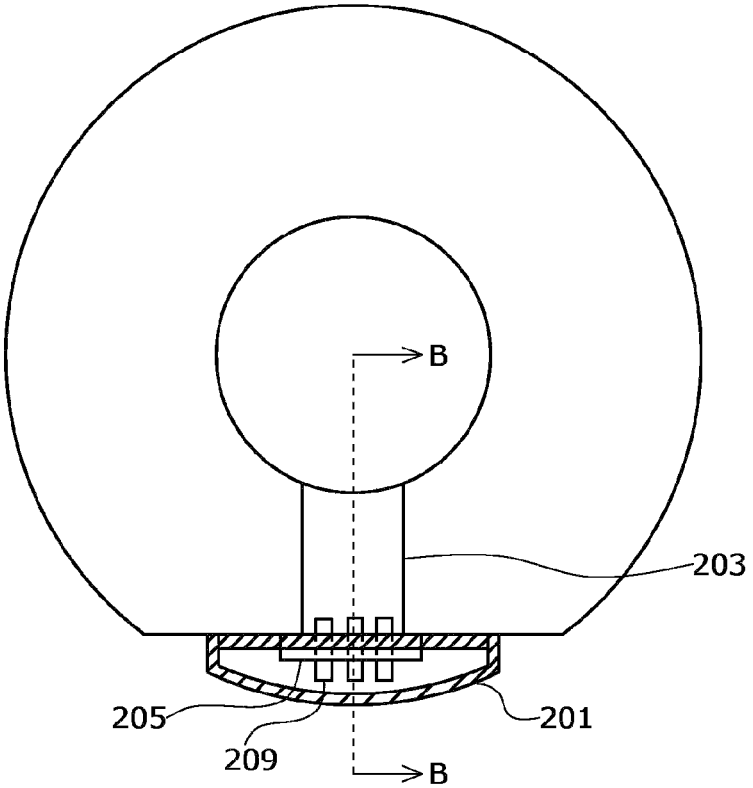
FIG. 4 is a horizontal sectional view taken along a sagittal line A-A in FIG. 3.

In FIG. 2, a wall portion 202 is circumferentially protrusively provided in side portions of the base portion 129 and the control apparatus 200. In addition, a wall portion cover 201 is attachably and detachably provided so as to cover and fit with the wall portion 202. FIG. 3 shows a front view of the base portion 129 and the control apparatus 200 including the wall portion cover 201 and FIG. 4 shows a horizontal sectional view taken along a sagittal line A-A in FIG. 3. Furthermore, FIG. 2 shows a vertical sectional view around the base portion 129 and the control apparatus 200 taken along a sagittal line B-B in FIG. 4.

A space 203 for a magnetic bearing, wiring of a motor, and the like inside the pump main body 100 is formed inside the base portion 129. The space 203 is filled with a vacuum atmosphere but, on the other hand, the control apparatus 200 and a connection portion with the control apparatus 200 is in air atmosphere.

In addition, a hermetic connector 205 is mounted to a wall portion around a right end of the space 203. An O-ring (not shown) is arranged in an O-ring groove 207 between the hermetic connector 205 and the base portion 129. A large number of pins 209 penetrate the hermetic connector 205. A right end of the pin 209 is exposed and penetrates a small hole (not shown) of a relay substrate 211. The pin 209 is soldered at the small hole portion of the relay substrate 211 which provides connection to the control apparatus 200 with respect to the relay substrate 211.

A terminal 213 is arranged at a lower end of the relay substrate 211 and configured so that one end of a harness 215 is attachable and detachable to and from the terminal 213. Another end of the harness 215 extends into the control apparatus 200. On the other hand, a control cable and a power cable (not shown) are connected to a left end of the pin 209 and passed inside the space 203.

A lid 217 is arranged in an upper portion of a chassis which forms the control apparatus 200. A gap 210 of around 1 mm is formed to provide heat insulation between the base portion 129 and the control apparatus 200. An annular or band-shaped sealing member 219 is interposed on an outer peripheral side in the gap 210 so that water droplets do not penetrate inside. In addition, a gap cover portion 201*a* is brought into contact with the base portion 129 and the control apparatus 200 so as to cover right ends of the sealing member 219 and the lid 217. The gap cover portion 201*a* is protrusively provided inside the cover along the gap 210. The gap cover portion 201*a* may be configured separately from the lid 217 and the chassis portion of the control apparatus 200 or may be integrally configured with the lid 217 and the chassis portion of the control apparatus 200 as will be described later.

As shown in FIG. 4, the wall portion cover 201 is formed in a curved surface shape so as to conform to outer shapes of the base portion 129 and the control apparatus 200. However, when the pump has a square shape, the wall portion cover 201 is desirably formed in a flat surface shape or the like so as to conform to the shape of the pump. In addition, as shown in FIG. 3, the wall portion cover 201 is formed so as to have a short peripheral length on a side of the base portion 129 and a long peripheral length on a side of the control apparatus 200 in accordance with routing of wiring.

Next, an action of the first embodiment of the present disclosure will be described.

First, a procedure when performing maintenance work will be described with reference to FIGS. 5A to 5D. As shown in FIG. 5A, when performing maintenance work, the wall portion cover 201 is removed from side portions of the base portion 129 and the control apparatus 200. In FIG. 5B, the harness 215 is detached from the terminal 213. Next, in FIG. 5C, a bolt (not shown) fixing the base portion 129 and the control apparatus 200 to each other is removed and the chassis of the control apparatus 200 is lowered by around several ten millimeters. Subsequently, as shown in FIG. 5D, the chassis of the control apparatus 200 is pulled out in the radial direction of the pump.

Accordingly, the pump main body 100 and the control apparatus 200 can be readily attached and detached even when sufficient empty space is not available in the axial direction of the vacuum pump. In this case, maintenance work of the control apparatus 200 can be readily performed even in a state where the pump main body 100 is mounted to a chamber (not shown). Since the terminal is arranged in a side portion of the vacuum pump, by removing the wall portion cover 201, the terminal becomes easily viewable and the harness 215 can be easily attached to and detached from the terminal 213.

Next, a function of preventing water droplets and the like from penetrating into the connector connecting portion during maintenance work will be described.

Cooling by a water-cooled tube may cause condensation to form around the base portion 129. In addition, there is a risk that water droplets may leak from the water-cooled tube during maintenance. In consideration thereof, as shown in FIG. 2, the wall portion 202 is circumferentially protrusively provided so as to expand from the base portion 129 to the control apparatus 200 in side portions of the base portion 129 and the control apparatus 200. Therefore, even when the wall portion cover 201 is removed during maintenance work, infiltration of water droplets can be prevented by the wall portion 202. Furthermore, the sealing member 219 and the lid 217 are inserted into the gap 210. Therefore, water droplets cannot easily penetrate into the gap 210.

In addition, the gap cover portion 201*a* is brought into contact with the base portion 129 and the control apparatus 200 so as to cover the right ends of the sealing member 219 and the lid 217. As a result, infiltration of water droplets that flow along the gap 210 can be more rigidly prevented. Accordingly, safety of circuits during maintenance work can be reliably ensured.

Moreover, when the sealing member 219 is arranged in this manner, the wall portion 202 may be separated into the side of the base portion 129 and the side of the control apparatus 200. In addition, a notch for routing a cable to outside may be formed in a part of the wall portion 202. In this case, the wall portion on the side of the base portion 129 is desirably configured as a U-shaped wall in which walls are protrusively provided on eaves and both sides. The wall portion on the side of the control apparatus 200 may be partially provided with a notch at a location where the sealing member 219 is provided.

Figure 6:
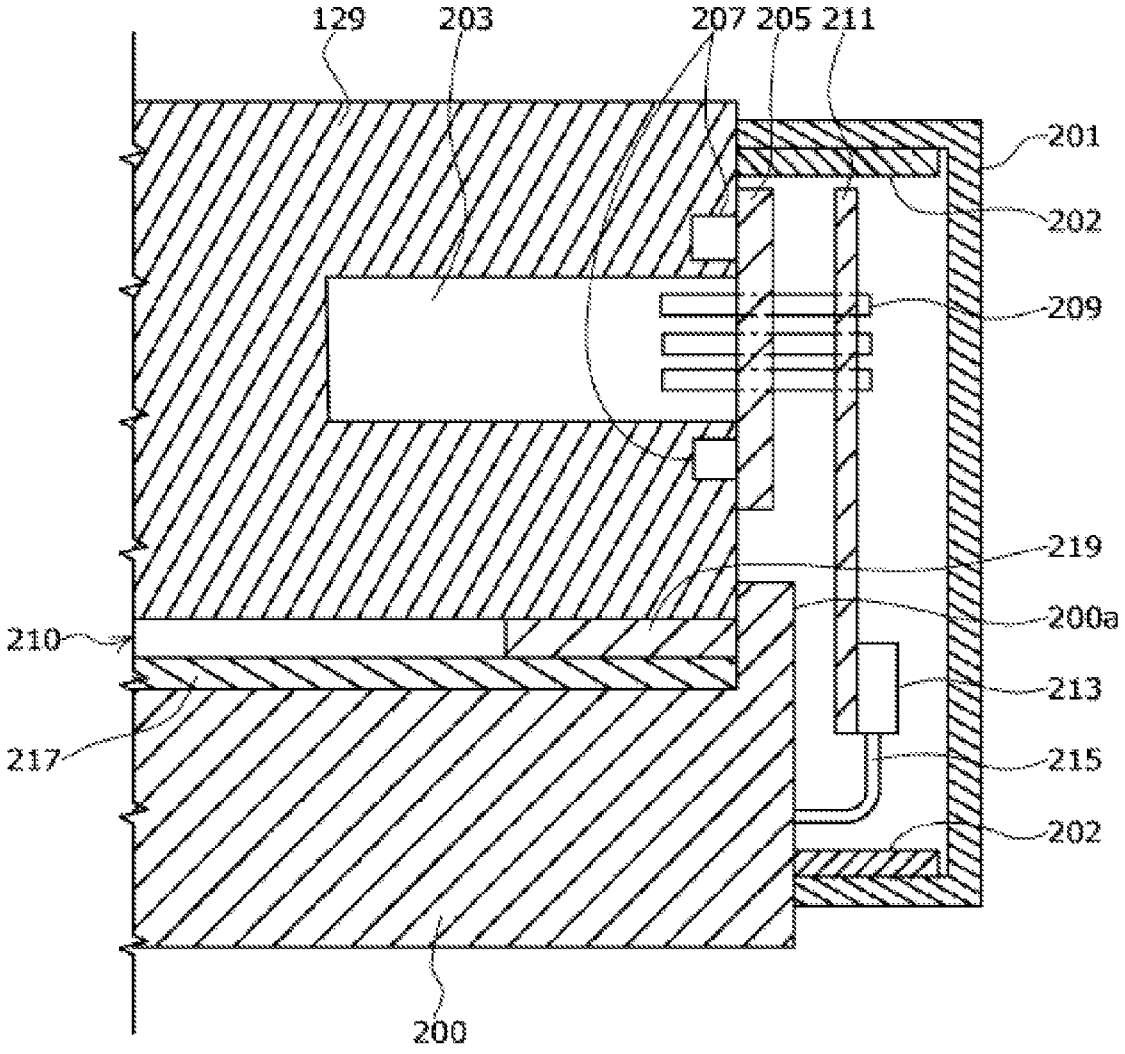
FIG. 6 is a vertical sectional view (alternate aspect) around a base portion and a control apparatus.

A configuration shown in FIG. 6 may be adopted in place of the gap cover portion 201*a* shown in FIG. 2. Specifically, on a side surface on a side facing the relay substrate 211 of the chassis that forms the control apparatus 200, a protrusive portion 200*a* is provided so as to protrude upward in the axial direction up to a range which covers thicknesses of the lid 217 and the sealing member 219. As a result, water droplets cannot easily penetrate into the gap 210 in a similar manner to FIG. 2. Accordingly, safety of circuits during maintenance work can be ensured.

Figure 7:
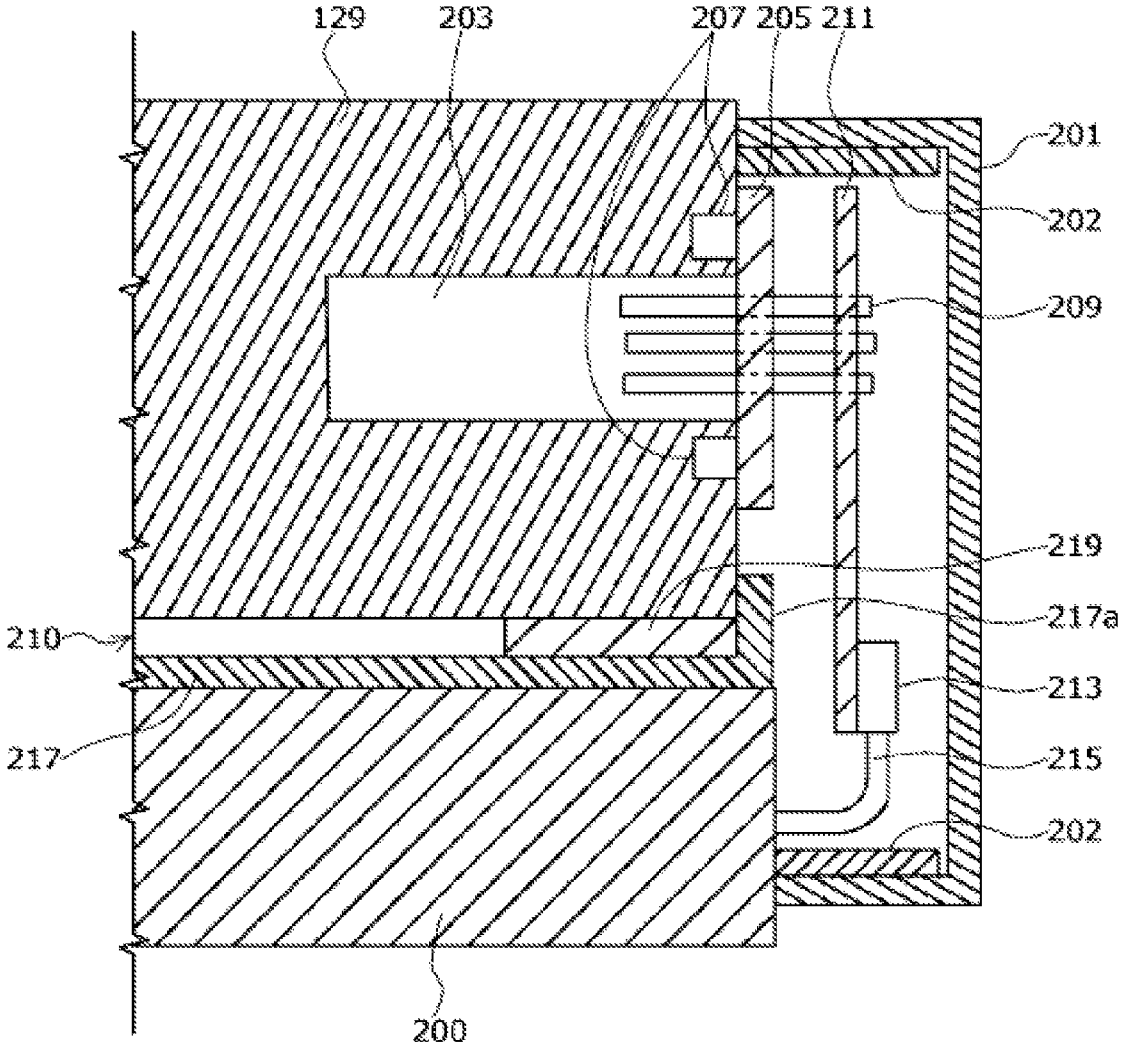
FIG. 7 is a vertical sectional view (alternate aspect) around a base portion and a control apparatus.

In addition, a configuration shown in FIG. 7 may be adopted in place of the gap cover portion 201*a* shown in FIG. 2. Specifically, the right end of the lid 217 is bent in an L-shape up to a range which covers the thickness of the sealing member 219 to form a bent part 217*a*. Even in this case, in a similar manner to that described above, water droplets cannot easily penetrate into the gap 210. Accordingly, safety of circuits during maintenance work can be ensured.

Next, a second embodiment of the present disclosure will be described.

Figures 8A, 8B:
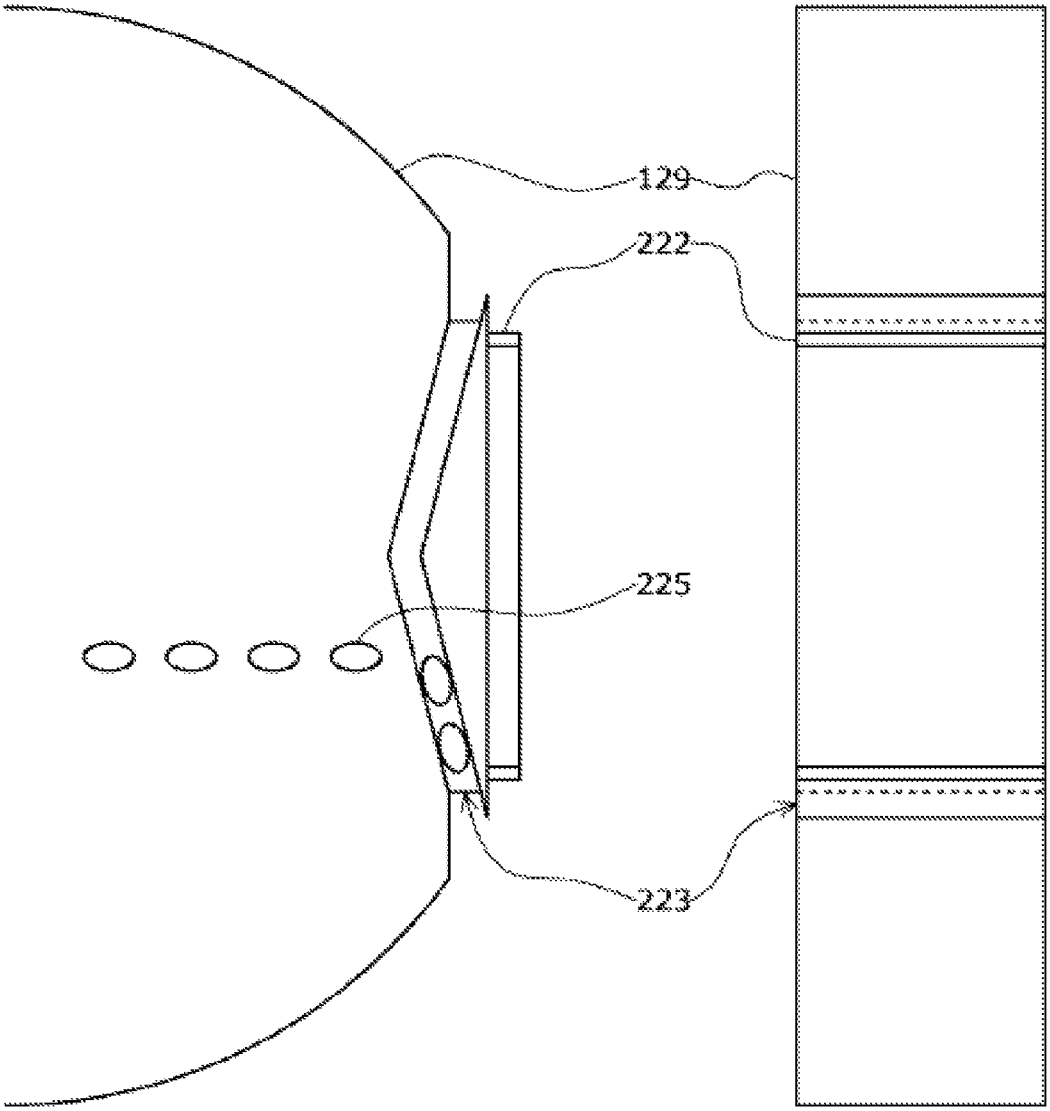
FIGS. 8A and 8B are configuration diagrams of a second embodiment of the present disclosure.

The second embodiment of the present disclosure represents a structure in which water droplets are guided and drained from the control apparatus 200 by forming a groove and a hole with respect to a wall portion. FIG. 8A is a plan view showing a cover of the base portion being removed and FIG. 8B is a side view of the base portion. In FIGS. 8A and 8B, a wall portion 222 is protrusively provided around the hermetic connector 205 (not shown). In addition, a wall portion cover 201 (not shown) is attachably and detachably provided so as to cover and fit with the wall portion 222. A groove 223 is formed in an outer periphery of the wall portion 222 and configured so that a water droplet 225 flows along the groove 223.

In the configuration described above, since the water droplet 225 flows along the groove 223 even when the wall portion cover 201 is removed, the water droplet 225 does not penetrate inside. Accordingly, safety of circuits during maintenance work can be ensured. Moreover, the wall portion 222 may have a shape other than a triangle such as a square or a circle as long the wall portion 222 is structured so that the water droplet 225 flows along the groove 223.

Figures 9A, 9B:
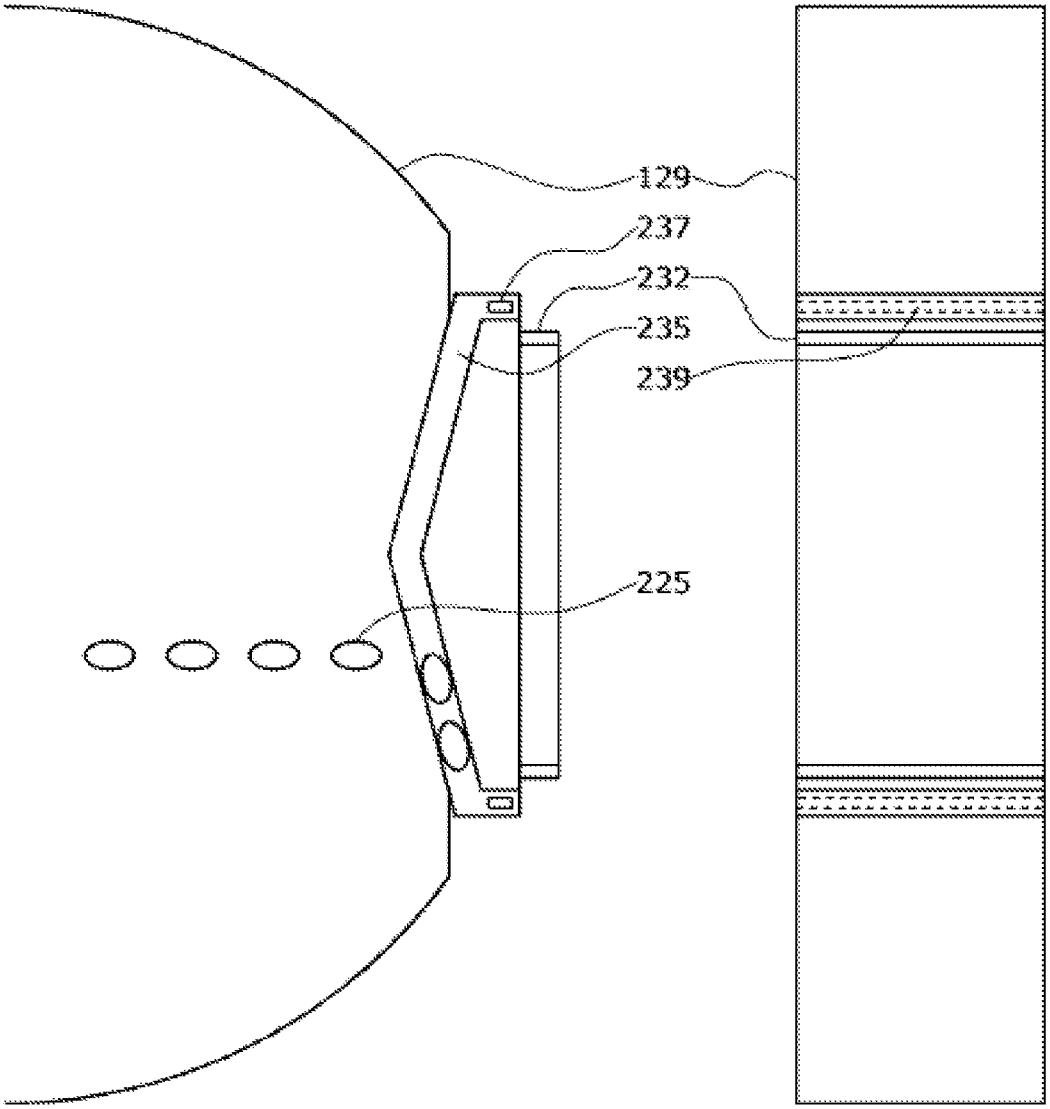
FIGS. 9A and 9B are diagrams showing an alternate aspect of the second embodiment.

In addition, FIGS. 9A and 9B are diagrams showing an alternate aspect of the second embodiment. FIG. 9A is a plan view showing a cover of the base portion being removed and FIG. 9B is a side view of the base portion. In FIGS. 9A and 9B, a wall portion 232 is protrusively provided around the hermetic connector 205 (not shown). In addition, a wall portion cover 201 (not shown) is attachably and detachably provided so as to cover and fit with the wall portion 232. A groove 235 is formed on an upper surface of the wall portion 232 and configured so that a water droplet 225 flows along the groove 235. The groove 235 is connected to a hole 237, and the hole 237 constitutes an inlet of a through-hole 239. The water droplet 225 having traveled along the groove 235 passes through the through-hole 239 and drops.

In the configuration described above, since the water droplet 225 flows along the groove 235 and through the hole 237 and the through-hole 239 even when the wall portion cover 201 is removed, the water droplet 225 does not penetrate inside. Accordingly, safety of circuits during maintenance work can be ensured.

It is to be understood that configurations may be adopted which appropriately combine the respective embodiments and modifications of the present disclosure. In addition, it will be obvious to those skilled in the art that various changes and modifications may be made without departing from the spirit of the present disclosure and that the present disclosure also encompasses such changes and modifications.

REFERENCE SIGNS LIST

10 Turbo-molecular pump
100 Pump main body
129 Base portion
200 Control apparatus
200*a* Protrusive portion
201 Wall portion cover
201*a* Gap cover portion
202, 222, 232 Wall portion
205 Hermetic connector
210 Gap
211 Relay substrate
213 Terminal
215 Harness
217 Lid
217*a* Bent part
219 Sealing member
223, 235 Groove
225 Water droplet
237 Hole
239 Through-hole

What is claimed is:

1. A vacuum pump in which a control apparatus is detachably arranged with respect to a base portion of a pump main body, the vacuum pump comprising:
- a waterproof structure, wherein the waterproof structure comprises:
  - a connector portion which is arranged in a side portion of the base portion and which connects the base portion with the control apparatus via an electric cable;
  - a wall portion which is protruding from the base portion to the control apparatus; and
  - a wall portion cover which covers the wall portion, wherein the wall portion cover has a curved shape that has curvature that substantially matches respective curvatures of the base portion and the control apparatus, and wherein the waterproof structure is located on a lateral side of the base portion and the control apparatus.

2. The vacuum pump according to claim 1, further comprising:
- a gap formed between the base portion and the control apparatus, wherein
- a gap cover portion which covers an outer periphery of the gap is arranged inside the wall portion cover.

3. The vacuum pump according to claim 1, further comprising:
- a gap formed between the base portion and the control apparatus, wherein
- an outer periphery of the gap is covered by protrusively providing an outer peripheral surface of the control apparatus on a side of the base portion of the pump main body.

4. The vacuum pump according to claim 1, further comprising:
- a gap formed between the base portion and the control apparatus; and
- a bent part formed by bending an end of an upper surface of the control apparatus toward a side of the base portion of the pump main body, wherein
- an outer periphery of the gap is covered by the bent part.

5. The vacuum pump according to claim 2, wherein a sealing member for preventing infiltration of water into the gap is arranged with respect to the gap.

6. The vacuum pump according to claim 1, wherein a groove or a hole for draining water is formed in the wall portion or on the upper surface of the control apparatus.

7. The vacuum pump according to claim 3, wherein a sealing member for preventing infiltration of water into the gap is arranged with respect to the gap.

8. The vacuum pump according to claim 4, wherein a sealing member for preventing infiltration of water into the gap is arranged with respect to the gap.

9. The vacuum pump according to claim 2, wherein a groove or a hole for draining water is formed in the wall portion or on the upper surface of the control apparatus.

10. The vacuum pump according to claim 3, wherein a groove or a hole for draining water is formed in the wall portion or on the upper surface of the control apparatus.

11. The vacuum pump according to claim 4, wherein a groove or a hole for draining water is formed in the wall portion or on the upper surface of the control apparatus.

12. A waterproof structure comprising:

a connector portion which is arranged in a side portion of a base portion of a pump main body of a vacuum pump and which connects the base portion with a control apparatus of the vacuum pump via an electric cable;

a wall portion which is protruding from the base portion to the control apparatus; and a wall portion cover which covers the wall portion, wherein the wall portion cover has a curved shape that has curvature that substantially matches respective curvatures of the base portion and the control apparatus, and wherein the waterproof structure is located on a lateral side of the base portion and the control apparatus.

13. A control apparatus, wherein the control apparatus is applied to a vacuum pump comprising a pump main body comprising a base portion; and a waterproof structure, wherein the waterproof structure comprises: a connector portion which is arranged in a side portion of the base portion and which connects the base portion with the control apparatus via an electric cable; a wall portion which is protruding from the base portion to the control apparatus; and a wall portion cover which covers the wall portion, wherein the wall portion cover has a curved shape that has curvature that substantially matches respective curvatures of the base portion and the control apparatus;

wherein the waterproof structure is located on a lateral side of the base portion and the control apparatus, and wherein the control apparatus is attachable and detachable with respect to the pump main body by moving in a radial direction.

* * * * *